US007354319B2

(12) United States Patent
Camino et al.

(10) Patent No.: US 7,354,319 B2
(45) Date of Patent: Apr. 8, 2008

(54) ELECTRICAL TERMINAL

(75) Inventors: Manuel Camino, Schieder-Schwalenberg (DE); Juergen Brand, Detmold (DE); Hans Hilmar Schulte, Schieder-Schwalenberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 11/611,650

(22) Filed: Dec. 15, 2006

(65) Prior Publication Data

US 2007/0141910 A1 Jun. 21, 2007

(30) Foreign Application Priority Data

Dec. 15, 2005 (DE) ..... 10 2005 060 410

(51) Int. Cl.
*H01R 4/48* (2006.01)

(52) U.S. Cl. ..... 439/828; 439/441

(58) Field of Classification Search ..... 439/610, 439/835, 789, 828, 152–160, 438–441, 829, 439/786, 417, 834, 409, 406, 434, 395, 436–437
See application file for complete search history.

(56) References Cited

U.S. PATENT DOCUMENTS

| | | | | |
|---|---|---|---|---|
| 3,596,229 A | | 7/1971 | Hohorst | |
| 4,759,726 A | | 7/1988 | Naylor et al. | |
| 5,679,021 A | * | 10/1997 | Kramer | 439/835 |
| 6,270,383 B1 | * | 8/2001 | Wielsch et al. | 439/828 |
| 6,773,313 B2 | * | 8/2004 | Pedrinelli et al. | 439/828 |
| 7,115,001 B1 | * | 10/2006 | Brockman et al. | 439/828 |

FOREIGN PATENT DOCUMENTS

| | | |
|---|---|---|
| DE | 25 50 943 B2 | 9/1976 |
| DE | 195 29 028 A1 | 1/1997 |
| DE | 198 17 924 A1 | 10/1999 |
| DE | 202 01 090 U1 | 7/2002 |
| DE | 103 19 851 A1 | 11/2004 |
| EP | 1 213 792 A1 | 6/2002 |
| EP | 1 432 075 A1 | 6/2004 |
| FR | 579 644 | 10/1924 |
| WO | 2004 027935 A1 | 4/2004 |

OTHER PUBLICATIONS

European Search Report, EP 06 02 3809, Dated Jul. 11, 2007.

* cited by examiner

*Primary Examiner*—Edwin A. Leon
(74) *Attorney, Agent, or Firm*—David S. Safran

(57) ABSTRACT

An electrical terminal includes an insulating housing, a conductor bar, strain-relief clamp connections and actuating elements located in the insulating housing for opening and closing the strain-relief clamp connections. The electrical terminal enables simple manual opening of the clamping site even when the strain-relief clamp connection is designed for leads with large cross section since the actuation element is made as an actuating cam that is eccentrically supported in the insulating housing. The actuating cam can be pivoted by an actuating tool out of a first position in which the strain-relief clamp connection is closed into a second position in which the strain-relief clamp connection is opened so that an electric lead can be inserted between the conductor bar and a through opening in the strain relief clamp connection.

20 Claims, 3 Drawing Sheets

ELECTRICAL TERMINAL

BACKGROUND OF THE INVENTION

1. Field of the Invention

The invention relates to an electrical terminal, especially a high current terminal, with a strain relief device.

2. Description of Related Art

Electrical terminals with contact elements made as tension springs, often called tension spring terminals, have been used for decades in industrial connection technology. In addition, electrical terminals with a screw-type terminal have been used for decades. The clamping principle for tension spring terminals is similar to that of screw technology. While in screw-type terminals a tension sleeve pulls the lead against a conductor bar by actuating the clamping screw, for a tension spring terminal this task can be assumed by a tension spring bent into a loop shape. The pretensioned tension spring is opened with an actuating tool, such as a screwdriver, so that the lead can be inserted into a through opening in the clamping leg of the tension spring into the terminal space. After removing the actuating tool, the lead is pulled by spring force against the conductor bar, which adjoins the contact leg of the tension spring.

One modification of the above described tension spring terminals is represented by electrical terminals with at least one strain-relief clamp connection as a spring force clamping terminal. With these electrical terminals, based on the special configuration of the strain-relief clamp connection, electric leads with a relatively large cross section of preferably 35 $mm^2$ to 150 $mm^2$ can be connected. In contrast, generally leads with cross sections of 1.5 $mm^2$, 2.5 $mm^2$, 4 $mm^2$, 6 $mm^2$, and 10 $mm^2$ to 35 $mm^2$, and those with special configurations, are connected to "normal" tension spring terminals. Since higher currents can be transmitted via electric leads with a larger cross section, electrical terminals made for connecting to leads with a large cross section are often also called high current terminals.

High current terminals are made both with a screw-type terminal and with a spring force clamping terminal. The high clamping forces of the screw-type terminal or spring force clamping terminal are achieved in the prior art by the respective clamping terminals, i.e. the contact element, which is designed to be thicker, extending from the electrical terminals for connection of "normal" leads. However, since high current terminals must also be manually actuated for opening the clamping sites against the respective clamping force of the clamping terminal, maximization of the type of construction of conventional terminals is limited, since lead cross sections starting with 50 $mm^2$ often require excessive handling forces.

Electrical terminals for use as high current terminals have been developed that have strain-relief clamp connections, which consist of a generally U-shaped strain-relief clamp and a compression spring. The compression spring is located in the strain-relief clamp such that it pulls or biases the bottom end of the strain-relief clamp against the bottom of a conductor bar that extends through openings in the clamping leg of the strain relief clamp. By this, an electric lead inserted through the through opening in the clamping leg of the strain-relief clamp is clamped fast against the bottom of the conductor bar. In electrical terminals designed for leads with large cross sections, the clamping site of this strain-relief clamp connection, for which the compression spring must be axially compressed, can only be opened using support measures.

One known electrical terminal is disclosed in DE 198 17 924 C2. In this high current terminal, the actuating element for opening and closing the strain-relief clamp connection is a feed rotation cylinder, which is supported in the insulating housing above the strain-relief clamp and coaxially with the compression spring of the strain-relief clamp connection. The rotation cylinder has an outside thread so that it can be screwed into an inside thread formed on the insulating housing by means of a rotary tool that can be axially inserted into the cylinder. When the feed rotation cylinder is screwed in, the strain-relief clamp is pressed against the compression spring. The compression spring is thus compressed, by which the strain-relief clamp connection is opened so that an electric lead to be connected can be inserted between the lower edge of the through opening in the clamping leg of the tension spring and the conductor bar.

When using compression springs with high spring force, the execution of the feed rotation cylinder allows the clamping site to be manually opened without great expenditure of force. However, the configuration of the feed rotation cylinder and the inside thread in the insulating housing of the terminal are relatively complex and thus expensive to manufacture.

SUMMARY OF THE INVENTION

An object of embodiments of this invention is to provide an electrical terminal that enables simple manual opening of the clamping site, even with a strain-relief clamp designed for connection to leads with large cross section, which can be simply and thus economically produced.

In the electrical terminal in accordance with this invention, the actuation element is made as an actuating cam, which is eccentrically supported in the insulating housing such that the actuating cam can be pivoted out of a first position in which the strain-relief clamp connection is closed, by means of an actuating tool such as the tip of a screwdriver, into a second position in which the strain-relief clamp connection is opened, so that an electric lead can be inserted between the conductor bar and the lower edge of the through opening in the strain relief clamp.

Because the actuating element is made as an actuating cam that is eccentrically supported in the insulating housing, the complex configuration of the inside of the housing for the rotation cylinder used in the prior art is eliminated. The movement of the actuating cam replaces the need for rotating the feed rotation cylinder used in the prior art. Moreover, opening of the clamping site is easily possible by pivoting the actuating cam so that the clamping site can be opened in a very time-saving manner. The force necessary for compressing the compression spring can be simply applied by the actuating cam being pivoted by means of an actuating tool. In this way, a relatively large lever arm is achieved so that the force to be expended even for a compression spring with high spring force is limited and thus can be easily applied by the electrician.

Preferably, the actuating cam is supported in the insulating housing by at least one, preferably two pivots, which are held in the corresponding receivers in one or both side walls of the insulating housing. Alternatively, or preferably additionally, the actuating cam is supported on a complementary resting surface within the insulating housing, for which the actuating cam has an arc-shaped bearing region.

To pivot the actuating cam out of the first position into the second position and vice-versa, the actuating cam preferably has a receiver into which the tip of the actuating tool can be inserted. The receiver is located in the actuating cam such that an actuating tool that has been inserted through the actuation opening in the insulating housing can easily engage the receiver. Alternatively, to assist in positioning the receiver in the actuating cam, the latter can also have a grip section that the electrician can use manually or with a tool to pivot the actuating cam from one position into the other position.

The actuating cam can also be configured to be self-locking in its second position in which the strain-relief clamp connection is opened. This ensures that a strain-relief clamp connection that has been opened for insertion of the electric lead to be connected cannot unintentionally spring back into the closed state. The self-locking of the actuating cam in the second position can be easily implemented, for example, by moving the actuating cam in the second position where its vertex does not press on the U-shaped back of the strain-relief clamp, but rather is slightly pivoted beyond the vertex. Before the compression spring can relax again, by which the strain-relief clamp connection is closed, the compression spring must first be additionally compressed a small distance axially against its spring force.

In addition, the self-locking of the actuating cam in the second position can also be implemented by providing the actuating cam with a flattened catch area that borders the arc-shaped bearing area. In this case, in the second position of the actuating cam with the strain-relief clamp connection opened, the bearing area interacts with the U-shaped back of the strain-relief clamp such that the actuating cam can be moved into the first position, in which the strain-relief clamp connection is closed, only by active pivoting with the actuating tool. This can be achieved by correspondingly high friction forces that must be overcome between the flattened catch area of the actuating cam and the U-shaped back of the strain-relief clamp.

In particular, there are many different possibilities for embodying and developing the electrical terminal in accordance with this invention, which will become apparent in view of the claims appended hereto and the detailed description below.

DETAILED DESCRIPTION OF THE INVENTION

Figure 1:
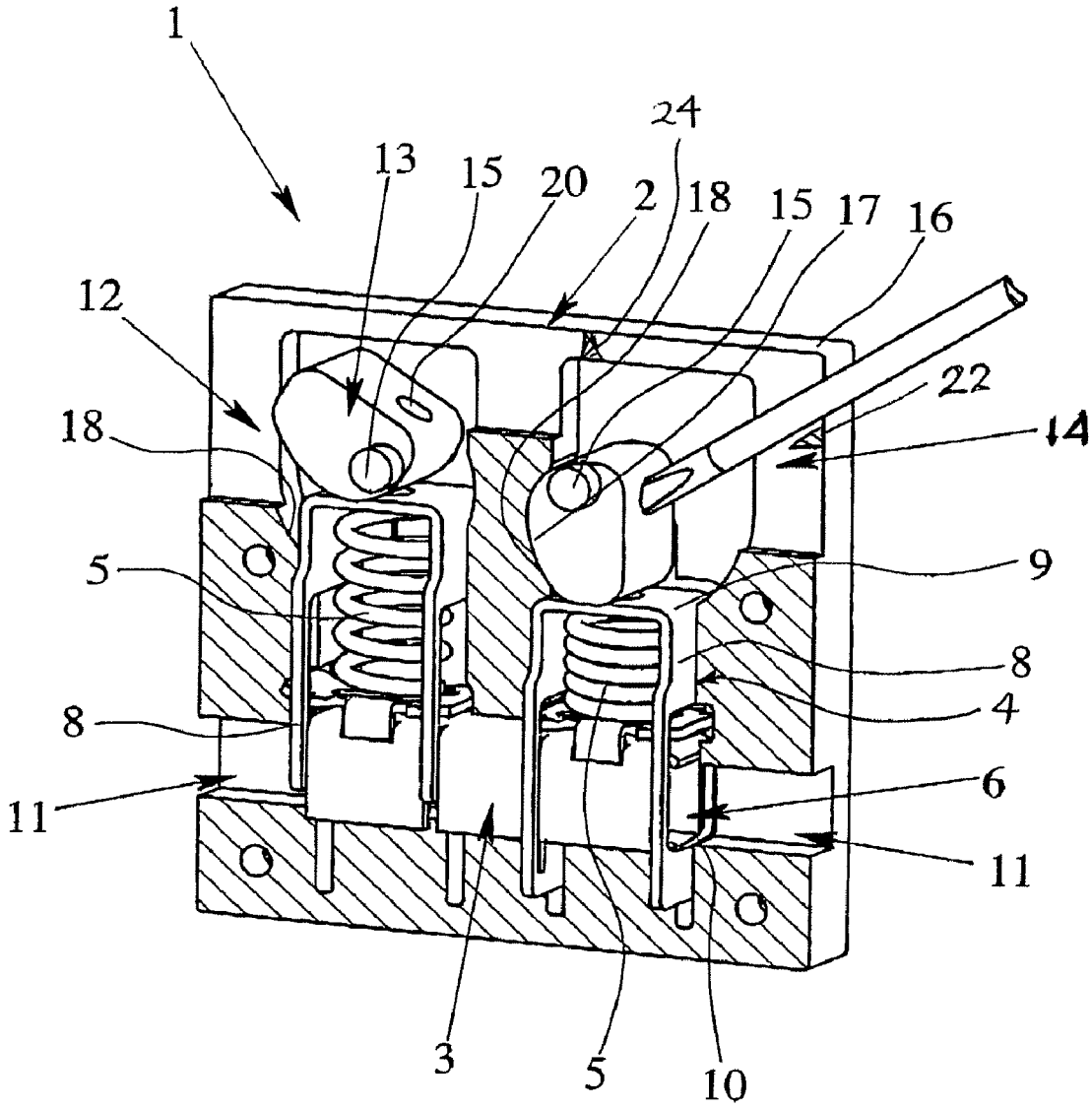
FIG. 1 is a side perspective view in partial section of an electric terminal in accordance with the invention.

FIG. 1 shows an electrical terminal 1 with an insulating housing 2, a conductor bar 3 located in the insulating housing 2, and two strain-relief clamp connections. The two strain relief clamp connections each have a generally U-shaped strain-relief clamp 4 and a helical compression spring 5 located within the strain-relief clamp 4. As is especially apparent from FIGS. 2 and 3, the strain-relief clamp 4 has two clamping legs 8 that each have one through opening 6 for inserting an electric lead 7 to be electrically connected, and a U-shaped back 9 that connects the clamping legs 8 to one another. The conductor bar 3 is inserted into the through openings 6 of the strain-relief clamp 4 so that the through openings 6 surround the conductor bar 3.

Figure 2:
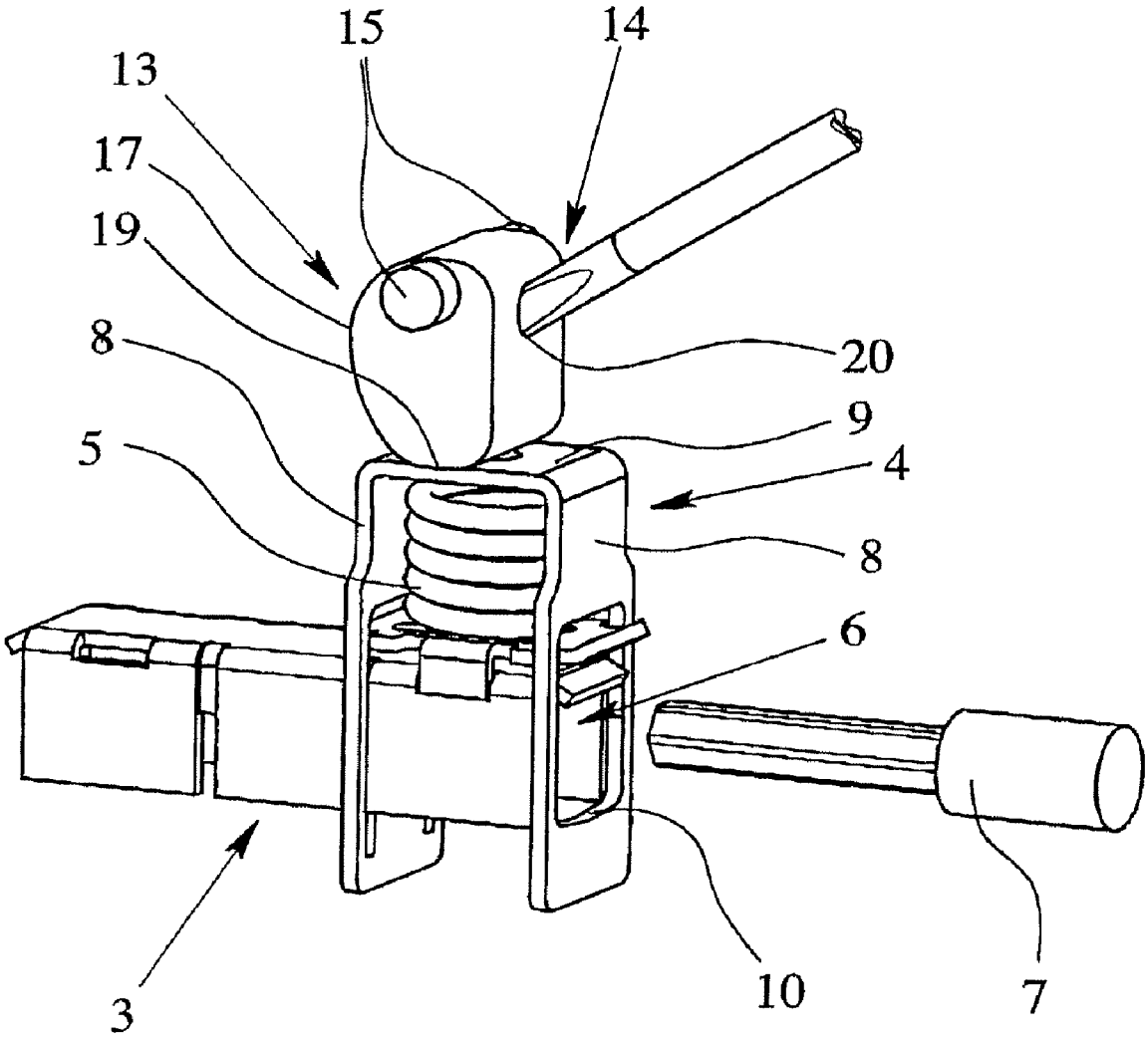
FIG. 2 is an enlarged view of the strain-relief clamp connection and the actuating cam in the second position with the strain-relief clamp connection opened; and, FIG. 3 is an enlarged view of the strain-relief clamp connection and the actuating cam with the electric lead connected.
Figure 3:
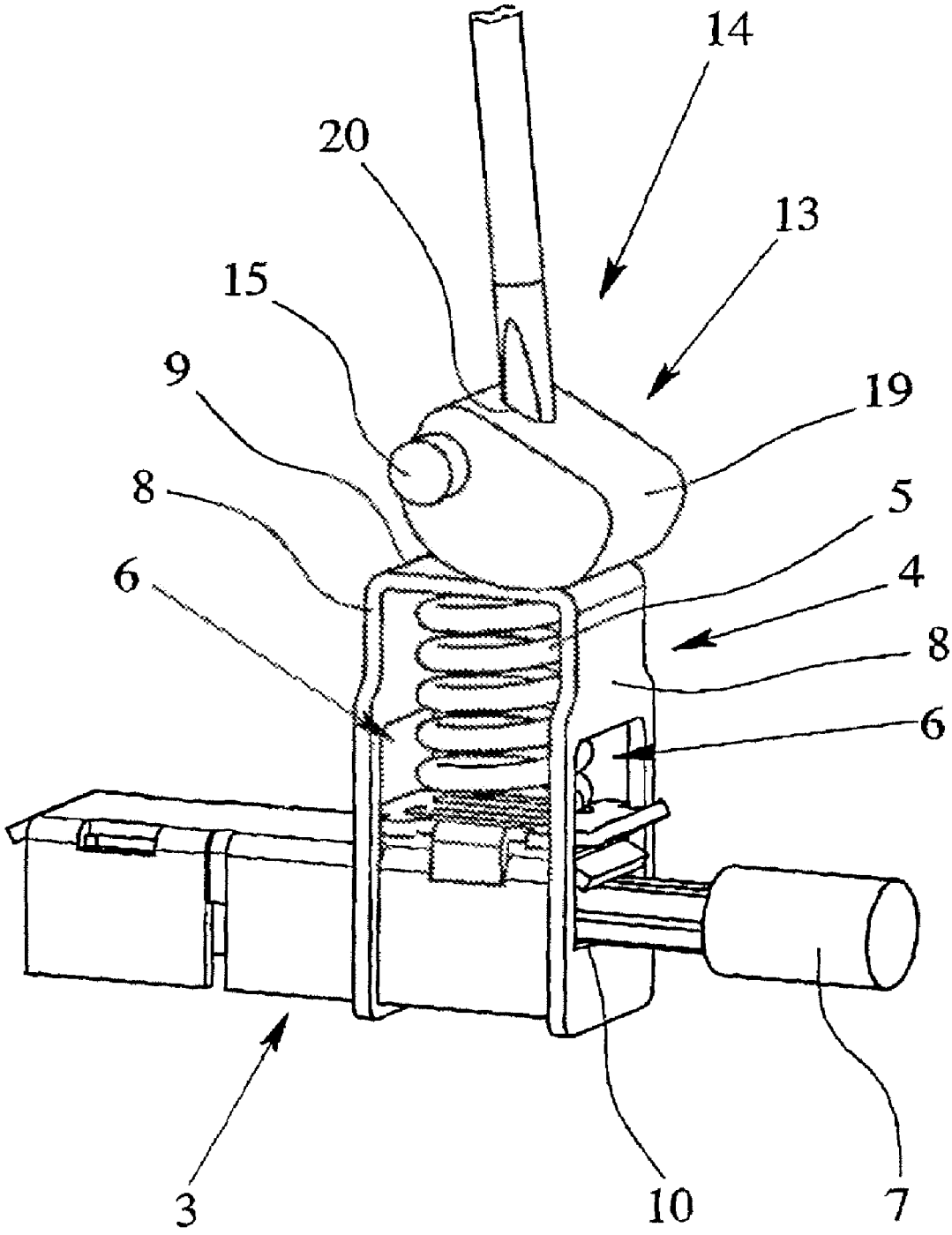

The compression spring 5 is located between the U-shaped back 9 of the strain-relief clamp 4 and the conductor bar 3 such that the compression spring 5 pulls the lower edge 10 of the through opening 6 against the conductor bar 3, i.e. in this illustrated arrangement upward. To open the strain-relief clamp connection, i.e., to insert the electric lead to be connected into the through opening 6 in the clamping leg 8, the compression spring 5 must be axially compressed so that the clamping point between the lower edge 10 of the through opening 6 and the conductor bar 3 is opened, as seen in FIG. 2. If the electric lead 7 is inserted into the through opening 6, the strain-relief clamp 4 is pressed up as a result of the spring force of the compression spring 5, by which the electric lead 7 is pressed by the lower edge 10 of the through opening 6 against the conductor bar 3, as seen in FIG. 3.

In the illustrated embodiment the conductor bar 3 is made generally U-shaped. The side walls of the conductor bar 3 are slotted so that one clamping leg 8 of the strain-relief clamp 4 at a time can move up with its lower edge 10 within the slot to against the bottom of the conductor bar 3. This can be appreciated from FIG. 1.

To insert the electric lead 7 to be connected into the two strain-relief clamp connections, two lead insertion openings 11 are provided in the insulating housing 2. The insulating housing 2 also has two actuation openings 12, only partially shown in FIG. 1 due to the cutaway representation. A corresponding actuating tool, for example the tip 14 of a screwdriver, for pivoting of the actuating element, in this case the actuating cam 13, can be inserted through the actuation openings 12. By simply pivoting the actuating cam 13 with the actuating tool the compression spring 5 can be axially compressed. By this, the strain-relief clamp 4 is moved down, by which the strain-relief clamp connection is opened. So, the electric lead 7 to be connected can be inserted through the lead insertion opening 11 into the through opening 6 in the clamping leg 8. If the actuating cam 13 is pivoted back into the first position, illustrated by the left-hand strain-relief clamp connection in FIG. 1, the strain-relief clamp 4 is moved up by the compression spring 5 so that the clamp site located between the bottom of the conductor bar 3 and the lower edge 10 of the through opening 6 closes. If an electric lead 7 has not been inserted into the clamping site, the strain-relief clamp connection is closed. If conversely the electric lead 7 has been inserted into the through opening 6, the conductor 7 is pulled from the lower edge 10 of the through opening 6 against the bottom of the conductor bar 3 and thus clamped (FIG. 3).

To support the actuating cam 13 in the insulating housing 2, the actuating cam 13 has two pivots 15 which are mounted in corresponding receivers in the side walls 16 of the insulating housing 2. Moreover, the actuating cam 13 has an arc-shaped bearing area 17 with which the actuating cam 13 is additionally supported on the corresponding resting surface 18 in the insulating housing 2. As is apparent from FIG. 1, the resting surface 18 runs perpendicular to the side walls 16 of the insulating housing 2. The actuating cam 13 and the pivot 15 are integrally connected to one another and are preferably made of plastic.

The actuating cam 13 is made and arranged such that it remains self-locking in the second position in which the strain-relief clamp connection is opened. For this purpose, the actuating cam 13 has a flattened catch area 19, which borders the arc-shaped bearing area 17 and rests on the U-shaped back 9 of the strain-relief clamp 4 in the second position, such that the actuating cam 13 can be released out of the second position and returned into the first position only by active pivoting by means of the actuating tool. This ensures that an opened strain-relief clamp connection remains in its opened position when the electric lead 7 to be connected is inserted so that the electrician has free hands for inserting the electric lead 7 into the lead insertion opening 11 and need not at the same time keep the actuating cam 13 in the second position using the actuating tool.

To simply pivot the actuating cam 13 out of the first position into the second position and vice versa, a receiver 20 is formed in the actuating cam 13 for the tip 14 of the actuating tool. Thus the tip 14 of the actuating tool can be simply inserted through the actuation opening 12 into the insulating housing 2 and into the receiver 20 in the actuating cam 13. When the actuating cam 13 is pivoted using the actuating tool, there is no danger that the tip 14 of the actuating tool will slip off the actuating cam 13. The receiver 20 thus together with the actuating tool facilitates movement of the actuating cam 13 out of the first position and into the second position and vice versa. As is apparent from the figures, the receiver 20 is located essentially opposite the bearing region 17 of the actuating cam 13. Any type of grip section can be provided on the actuating cam 13 to allow the cam 13 to be pivoted. It is also possible to shape the receiver as any formation that can offer a secure interface with the actuating tool and prevent the tool from slipping from the cam 13.

In the insulating housing 2, a stop 22 and 24 for each defined location of the first position (strain-relief clamp connection closed) and the second position (strain-relief clamp connection opened) can be provided. In this way, limitation of the maximum pivoting angle of the actuating cam 13 can be achieved. The stops can also be implemented simply by corresponding dimensioning of the actuation opening 12 in the insulating housing 2. The stops can be configured to interact with the actuating cam 13 or with the actuating tool.

As will be recognized by those of skill in the art, modifications and changes can be made to the invention disclosed herein and remain within the scope of the appended claims.

What is claimed is:

1. An electrical terminal, comprising:

an insulating housing having at least one lead insertion opening for inserting an electric lead for electrical connection and at least one actuation opening;

at least one conductor bar;

at least one strain-relief clamp connection positioned in the insulating housing and including a generally U-shaped strain-relief clamp and a compression spring, wherein the strain-relief clamp has two clamping legs, each having a through opening for inserting the electric lead, and a U-shaped back that connects the clamping legs to each other, and wherein the conductor bar is positioned within the through openings and the compression spring is located between the U-shaped back of the strain-relief clamp and the conductor bar such that the compression spring is axially compressed to open the strain-relief clamp connection for insertion of the electric lead between the conductor bar and a bottom edge of the through openings; and, at least one actuating element located in the insulating housing for opening and closing the strain-relief clamp connection, wherein the actuating element is movable between a first position in which the strain-relief clamp connection is closed and a second position in which the strain-relief clamp connection is open, wherein the actuating element is an actuating cam eccentrically supported in the insulating housing such that the actuating cam is pivotal between the first position and the second position.

2. The electrical terminal as claimed in claim 1, wherein the actuating cam is self locking in the second position.

3. The electrical terminal as claimed in claim 1, wherein the actuating cam has a receiver for engaging a tip of an actuating tool to pivot the actuating cam between the first position and the second position.

4. The electrical terminal as claimed in claim 1, wherein the insulating housing has at least one stop that limits movement of the actuating cam between the first position and the second position.

5. The electrical terminal as claimed in claim 1, wherein the insulating housing has stops that define the first position and the second position.

6. The electrical terminal as claimed in claim 1, wherein the terminal is a high current terminal.

7. The electrical terminal as claimed in claim 1, wherein the actuating cam is pivotally mounted to a side wall of the insulating housing.

8. The electrical terminal as claimed in claim 7, wherein actuating cam has a pivot integrally connected thereto.

9. The electrical terminal as claimed in claim 8, wherein the actuating cam and pivot are made of plastic.

10. The electrical terminal as claimed in claim 7, wherein the actuating cam has an arc-shaped bearing region and the insulating housing has side walls and a resting surface that extends generally perpendicular to the side walls and is complementary to the bearing region, wherein the bearing region of the actuating cam is supported on the resting surface.

11. The electrical terminal as claimed in claim 1, wherein the actuating cam has an arc-shaped bearing region and the insulating housing has side walls and a resting surface that extends generally perpendicular to the side walls and is complementary to the bearing region, wherein the bearing region of the actuating cam is supported on the resting surface.

12. The electrical terminal as claimed in claim 11, wherein the actuating cam has a flattened catch area that borders the arc-shaped bearing area and, in the second position of the actuating cam, interacts with the U-shaped back of the strain-relief clamp such that the actuating cam is released from the second position only by active pivoting with an actuating tool.

13. The electrical terminal as claimed in claim 12, wherein the actuating cam has a receiver for a tip of an actuating tool, wherein the receiver is located opposite the bearing area.

14. The electrical terminal as claimed in claim 12, wherein the actuating cam has a grip section located opposite the bearing area.

15. The electrical terminal as claimed in claim 1, wherein the conductor bar has slots that engage the clamping legs of the strain-relief clamp.

16. The electrical terminal as claimed in claim 15, wherein the insulating housing has slots that receive the clamping legs of the strain relief clamp when the actuating cam is pivoted into the second position.

17. A high current electrical terminal for receiving an electric lead, comprising:

an insulating housing;

a strain-relief clamp positioned within the housing, including a generally U-shaped strain-relief clamp member and a compression spring, wherein the strain-relief clamp member has two clamping legs, each of which has a through hole for inserting the electric lead, and a U-shaped back that connects the clamping legs to each other;

a conductor bar positioned in the housing and extending through the through the through holes so that an opening for receiving the electric lead is defined between the conductor bar and an edge of the through hole;

a spring positioned between the back of the clamp and the conductor bar to bias the clamp with respect to the conductor bar such that the compression spring is axially compressed to open the strain-relief clamp connection for insertion of the electric lead between the conductor bar and a bottom edge of the through openings, and an actuating cam eccentrically pivotally mounted to the housing and located adjacent to the back of the clamp, wherein the actuating cam is pivotal between a first position in which the clamp is biased away from the conductor bar and the opening is closed and a second position in which the clamp is pressed toward the conductor bar and the opening is open for insertion of the electric lead.

18. The high current electrical terminal as claimed in claim 17, wherein the actuating cam has a flattened catch area that self locks the actuating cam in the second position.

19. The high current electrical terminal as claimed in claim 17, wherein the actuating cam has an arc shaped bearing area and the housing has a complementary resting surface that guides the actuating cam while pivoting.

20. The high current electrical terminal as claimed in claim 19, wherein the actuating cam has a receiver positioned opposite from the bearing area for receiving an actuating tool for pivoting.

* * * * *